US010815607B2

(12) United States Patent
Costa et al.

(10) Patent No.: US 10,815,607 B2
(45) Date of Patent: Oct. 27, 2020

(54) DISPENSER FOR A LAUNDRY TREATING APPLIANCE

(71) Applicant: WHIRLPOOL CORPORATION, Benton Harbor, MI (US)

(72) Inventors: Marcos L. Costa, Joinville (BR); Diogo M. Rodrigues, Rio Claro (BR); Rui Silva, Rio Claro (BR)

(73) Assignee: Whirlpool Corporation, Benton Harbor, MI (US)

( * ) Notice: Subject to any disclaimer, the term of this patent is extended or adjusted under 35 U.S.C. 154(b) by 115 days.

(21) Appl. No.: 16/005,805

(22) Filed: Jun. 12, 2018

(65) Prior Publication Data

US 2019/0376223 A1 Dec. 12, 2019

(51) Int. Cl.
*D06F 39/02* (2006.01)
*D06F 39/08* (2006.01)

(52) U.S. Cl.
CPC ..... *D06F 39/024* (2013.01); *D06F 39/022* (2013.01); *D06F 39/083* (2013.01); *D06F 39/088* (2013.01)

(58) Field of Classification Search
CPC ..... D06F 39/024
See application file for complete search history.

(56) References Cited

U.S. PATENT DOCUMENTS

| | | | | |
|---|---|---|---|---|
| 3,596,480 | A | 8/1971 | Douglas | |
| 3,724,242 | A | 4/1973 | Davis | |
| 3,736,773 | A | 6/1973 | Waugh | |
| 4,478,059 | A | 10/1984 | Yates | |
| 5,500,967 | A * | 3/1996 | Wilson | D06F 39/024 68/17 A |

* cited by examiner

*Primary Examiner* — Spencer E Bell
(74) *Attorney, Agent, or Firm* — McGarry Bair PC

(57) ABSTRACT

A laundry treating appliance with a dispenser and method dispensing where the laundry treating appliance comprises a basket at least partially defining a treating chamber with an open top, a clothes mover rotatable about a vertical axis within the treating chamber, the clothes mover defining an inner chamber and having an access opening to the inner chamber, and a dispenser at least partially received through the access opening and within the inner chamber.

22 Claims, 7 Drawing Sheets

DISPENSER FOR A LAUNDRY TREATING APPLIANCE

BACKGROUND

Laundry treating appliances, such as clothes washers, clothes dryers, refreshers, and non-aqueous systems, can have a configuration based on a rotating drum that defines a treating chamber having an access opening through which laundry items are placed in the treating chamber for treating. The laundry treating appliance can have a controller that implements a number of pre-programmed cycles of operation having one or more operating parameters.

In some laundry treating appliances, a user supplies the laundry treating appliance with a treating chemistry prior to or during each cycle of operation. The treating chemistry may be added directly to the treating chamber or added to a dispenser that supplies the treating chemistry to the treating chamber at the appropriate time in the cycle of operation. Some dispensers are located central to a treating chamber of the laundry treating appliance.

SUMMARY

In one aspect, the present disclosure relates to a laundry treating appliance comprising a basket at least partially defining a treating chamber with an open top, a clothes mover rotatable about a vertical axis within the treating chamber, the clothes mover defining an inner chamber and having an access opening to the inner chamber, and a dispenser at least partially received through the access opening and within the inner chamber, the dispenser having at least two dispensing compartments, which are fluidly separate from each other and fluidly coupled to the treating chamber.

In another aspect the present disclosure relates to a laundry treating appliance comprising a basket at least partially defining a treating chamber with an open top, a clothes mover mounted for rotational movement about a vertical axis within the treating chamber, the clothes mover defining an inner chamber and having an access opening to the inner chamber, and a dispenser at least partially received through the access opening and within the inner chamber, the dispenser having a flow-through dispenser and a centrifugal dispensing compartment, which are fluidly separate from each other and fluidly coupled to the treating chamber.

A method of dispensing at least two treating chemistries from a dispenser located in a clothes mover for a laundry treating appliance during a cycle of operation, the method comprising non-centrifugally dispensing a first treating chemistry into the treating chamber from a first dispenser located within the clothes mover, and centrifugally dispensing a second treating chemistry into the treating chamber from a second dispenser located within the clothes mover.

DESCRIPTION

Figure 1:
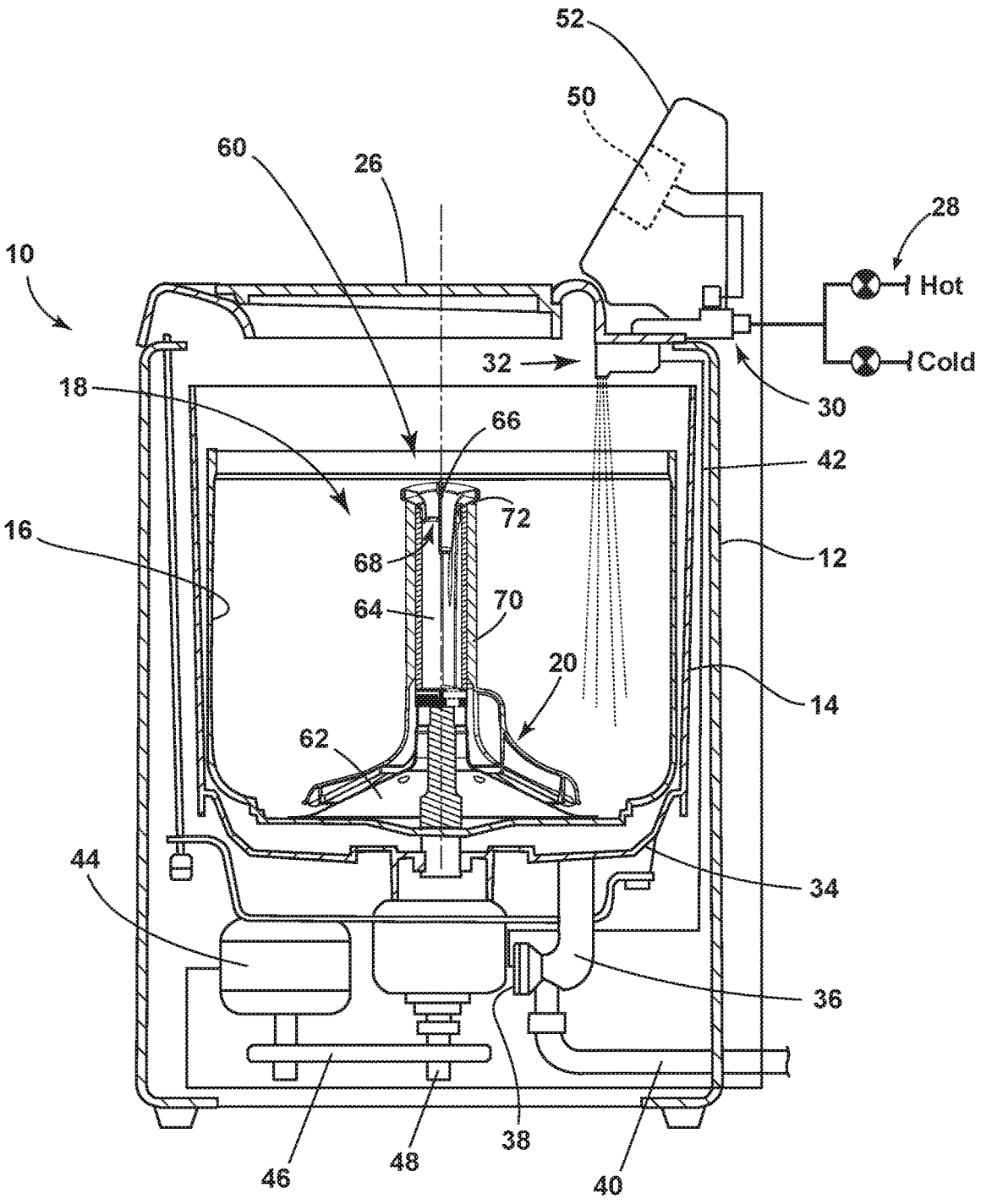
FIG. 1 is a schematic view of a laundry treating appliance in the form of a washing machine with a dispenser according to the present disclosure.

FIG. 1 is a schematic view of a laundry treating appliance having a clothes mover in which a dispenser is provided as described. While the illustrated laundry treating appliance is a vertical axis washing machine, the exemplary laundry treating appliance is not limiting to the dispenser as described. Depending on the implementation, a horizontal axis washing machine or dryer, can provide a suitable environment for the described dispenser. Similarly, the dispenser can be implemented in other laundry treating appliances such as: a combination washing machine and dryer; a tumbling or stationary refreshing/revitalizing machine; an extractor; a non-aqueous washing apparatus; and a revitalizing machine.

As used herein, the term "vertical axis" and "horizontal axis" washing machines refer to the manner in which mechanical energy is primarily applied to the laundry and is not an express limitation on the operational axis of the appliance. For vertical axis washing machines, a clothes mover, such as an impeller, pulsator, agitator, etc., rotates or reciprocates within a basket, which is typically stationary at the time, about a generally vertical axis to impart mechanical energy to the laundry. In a horizontal axis washing machine, a clothes mover is typically not present. Instead, a drum or basket is rotated about a generally horizontal axis to lift the laundry, which then falls in response to gravity. The repeated lifting/falling, which is referred to as tumbling, provides the mechanical energy to the laundry.

In either machine the rotational axis need not be perfectly vertical or horizontal, as the case may be. It is acceptable that the axis be at an angle of inclination to the vertical or horizontal axis. Vertical axis machines tend to have less, if any, angle of inclination than horizontal axis machines, the horizontal axis angle of inclination can be up to 15 to 20 degrees. The angle of inclination is referenced to a level surface.

FIG. 1 is a schematic view of a laundry treating appliance in the form of a vertical axis washing machine 10. The washing machine 10 includes a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the disclosure set forth herein.

The laundry holding system comprises a tub 14 supported within the cabinet 12 by a suitable suspension system and a drum 16 provided within the tub 14, with the drum 16 defining at least a portion of a laundry treating chamber 18. The drum 16 may include a plurality of perforations (not shown) such that liquid may flow between the tub 14 and the drum 16 through the perforations. It is also within the scope of an aspect of the disclosure herein for the laundry holding system to comprise only a tub with the tub defining the laundry treating chamber. A rotatable clothes mover 20 may be provided within the treating chamber 18 for imparting mechanical energy to the laundry items during a cycle of operation. The clothes mover 20 may be an agitator, impeller, nutator, or the like for imparting mechanical energy to the laundry items. The laundry holding system may further include a door 26 which may be movably mounted relative to the cabinet 12 to selectively close both the tub 14 and the drum 16.

The washing machine 10 may further include a liquid supply system for supplying water to the washing machine 10 for use in treating laundry during a cycle of operation. The liquid supply system may be fluidly coupled to a source of water, such as a household water supply 28 for controlling the flow of water to a water supply circuit 30 for distribution to one or more components of the washing machine 10. The water supply circuit 30 may be coupled with a water nozzle 32 for supplying water from the household water supply 28 to the tub 14 and/or drum 16. In the example illustrated in FIG. 1, the water nozzle 32 is configured to supply water into the drum 16. In another example, the water nozzle 32 may be configured to supply water directly into the tub 14. The water nozzle 32 may be configured to dispense a treating chemistry into the tub 14 or drum 16 in a desired pattern and under a desired amount of pressure, the details of which are not germane to the present disclosure.

The washing machine 10 may optionally include a recirculation and drain system for recirculating liquid within the laundry holding system and draining liquid from the washing machine 10. Liquid supplied to treating chamber 18 typically enters a space between the tub 14 and the drum 16 and may flow by gravity to a sump 34 formed in part by a lower portion of the tub 14. The sump 34 may also be formed by a sump conduit 36 that may fluidly couple the lower portion of the tub 14 to a pump 38. The pump 38 may direct liquid to a drain conduit 40, which may drain the liquid from the washing machine 10, or to a recirculation conduit 42, which may direct the liquid from the sump 34 into the drum 16. The recirculation conduit 42 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, the details of which are not germane to the present description. Non-limiting examples of heating systems include a steam generator and a sump heater. Additionally, the liquid supply, recirculation, drain systems may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 44, which may be directly coupled with the drum 16 through a belt 46 and a drive shaft 48 to rotate the drum 16, as is known in the art. Alternatively, the motor may be a brushless permanent magnet (BPM) motor, an induction motor, or a permanent split capacitor (PSC) motor. The motor 44 may rotate the drum 16 at various speeds in either rotational direction.

The washing machine 10 also includes a control system for controlling the operation of the washing machine 10 to implement one or more cycles of operation. The control system may include a controller 50 located within the cabinet 12 (optionally exterior of the cabinet 12) and a user interface 52 that is operably coupled with the controller 50. The user interface 52 may include one or more knobs, dials, switches, displays, touch screens and the like for communicating with the user, such as to receive input and provide output. The user may enter different types of information including, without limitation, cycle selection and cycle parameters, such as cycle options.

The controller 50 may include the machine controller and any additional controllers provided for controlling any of the components of the washing machine 10. For example, the controller 50 may include the machine controller and a motor controller. Many known types of controllers may be used for the controller 50. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

The controller 50 may be provided with a memory and a central processing unit (CPU). The memory may be used for storing the control software that is executed by the CPU in completing a cycle of operation using the washing machine 10 and any additional software. Examples, without limitation, of cycles of operation include: wash, heavy duty wash, delicate wash, quick wash, pre-wash, refresh, rinse only, and timed wash. The memory may also be used to store information, such as a database or table, and to store data received from one or more components of the washing machine 10 that may be communicably coupled with the controller 50. The database or table may be used to store the various operating parameters for the one or more cycles of operation, including factory default values for the operating parameters and any adjustments to them by the control system or by user input.

The controller 50 may be operably coupled with one or more components of the washing machine 10 for communicating with and controlling the operation of the component to complete a cycle of operation. For example, the controller 50 may be operably coupled with the motor 44, the pump 38, a steam generator, and a sump heater to control the operation of these and other components to implement one or more of the cycles of operation.

The controller 50 may also be coupled with one or more sensors provided in one or more of the systems of the washing machine 10 to receive input from the sensors, which are known in the art and not shown for simplicity. Non-limiting examples of sensors that may be communicably coupled with the controller 50 include: a treating chamber temperature sensor, a moisture sensor, a weight sensor, a chemical sensor, a position sensor and a motor torque sensor, which may be used to determine a variety of system and laundry characteristics, such as laundry load inertia or mass.

Still referring to FIG. 1, the washing machine 10 may include a dispenser 60 that is supported by the clothes mover 20. The clothes mover 20 is illustrated as an agitator having a base 62 from which extends a column 70. The column 70 defines an inner chamber 64 and has an upper end 72 defining an access opening 68 for the inner chamber 64. The dispenser 60 is received within the inner chamber 64 through the access opening 68. The dispenser 60 is sized and shaped to at least partially be received within the inner chamber 64 of the clothes mover 20 for dispensing a treating chemistry into the treating chamber 18.

The dispenser 60 may be supported within the column 70 using any suitable mechanical or non-mechanical fasteners, non-limiting examples of which include brackets, clamps, screws, adhesives, and welds. In one example, the dispenser 60 may be supported within the column 70 by an interference fit between the dispenser 60 and the column 70. In another example, the dispenser 60 may be supported at a top and/or bottom end by a flange extending from the column 70.

While portions of the dispenser 60, by way of non-limiting example a divider 82 (FIG. 2), will be described in the context of being removable from the column 70 of the clothes mover 20, the dispenser 60 as a whole can optionally be configured to remain within the column 70 or be integrally formed with the column 70 such that the column 70 forms at least a portion of the dispenser 60. The dispenser 60 is configured to allow a user to dispense a predetermined amount of treating chemistry into the treating chamber 18 by manually actuating the dispenser 60.

Figure 2:
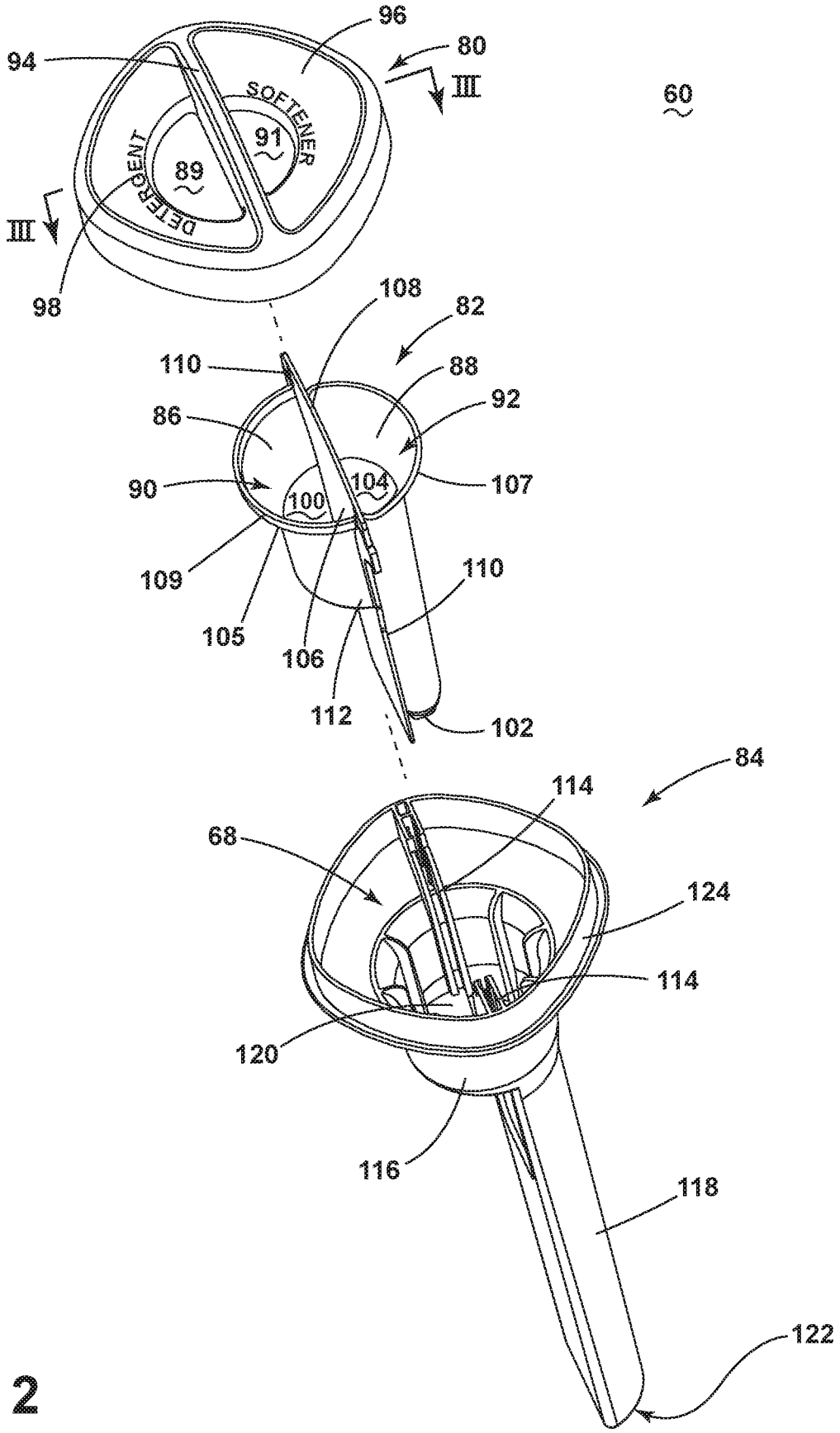
FIG. 2 is an exploded view of the dispenser for the laundry treating appliance of FIG. 1, the dispenser including a cap, divider, and funnel.

Turning to FIG. 2, an exploded view of the dispenser 60 illustrates that the dispenser can be formed in three main parts, a cap 80, a divider 82, and a funnel 84. The dispenser 60 can define at least two dispensing compartments, a first dispenser, illustrated as a flow-through dispensing compartment 86, and a second dispenser, a illustrated as a centrifugal dispensing compartment 88. The cap 80 can have at least two apertures, illustrated as a first and second aperture 89, 91, separated by a first dividing wall 94 and fluidly coupled to each of the at least two dispensing compartments 86, 88. In one aspect of the disclosure herein, the at least two apertures are different sizes, by way of non-limiting example the first aperture 89 is larger than the second aperture 91 to indicate a difference between the treating chemistries appropriate for each of the compartments to which they are each fluidly coupled. By way of non-limiting example the first aperture 89 is for receiving detergent and the second aperture 91 is for receiving fabric softener. A splash guard 96 defines the area surrounding the second aperture 91 can be utilized as a splash guard for the centrifugal dispensing compartment 88 according to aspects of the disclosure herein and later described in detail.

It is also contemplated that the cap 80 is optionally provided with indicia 98 indicating the type of compartment the apertures 89, 91 are opened to. The indicia may include text, graphics, coloring, and/or 3-dimensional features to provide information to a user regarding the type of treating chemistry appropriate for each individual compartment 86, 88. It is further contemplated that the cap 80 can have both indicia 98 and different sized apertures 89, 91.

In one aspect of the disclosure herein, the divider 82 can incorporate first and second dispensing compartments, where the first dispensing compartment is the flow-through dispensing compartment 86 and the second dispensing compartment is the centrifugal dispensing compartment 88. The flow-through dispensing compartment 86 extends vertically from a first inlet 90 to an open end 100 while the centrifugal dispensing compartment 88 extends vertically from a second inlet 92 to a closed end 102 to define a reservoir 104 for holding a treating chemistry, by way of non-limiting example fabric softener. The first and second inlets 90, 92 can be defined by semi-circular edges 105 and 107 respectively. A lip 109 extends vertically only from the semi-circular edge 105. It should be understood that when assembled the first aperture 89 and the first inlet 90 are in alignment and the second aperture 91 and second inlet 92 are in alignment.

The divider 82 can further include a second dividing wall 106 separating the flow-through dispensing compartment 86 from the centrifugal dispensing compartment 88. The second dividing wall 106 can extend above the divider 82 to define a tab 108. In one aspect of the disclosure herein the divider 82 is a removable divider. A user can remove the divider 82 via the tab 108. When assembled in place, the tab 108 is received within the first dividing wall 94 located in the cap 80 to further fluidly isolate the flow-through dispensing compartment 86 from the centrifugal dispensing compartment 88. The divider 82 can further include a pair of ribs 110 extending along an outer portion 112 of the divider 82.

The funnel 84 can include a pair of grooves 114 for receiving the pair of ribs 110 of the divider 82 when the divider 82 is received within the funnel 84. When assembled, the pair of ribs 110 together with the pair of grooves 114 provide stability for the divider 82 during operation.

In an aspect of the disclosure herein, it is contemplated that the funnel 84 defines the access opening 68 of the dispenser 60. The funnel 84 further comprises two fluidly separate fluid conduits 116, 118. A first fluid conduit 116 extends vertically to a first outlet 120. A second fluid conduit 118 extends vertically to a second outlet 122. The funnel 84 can further include a ridge 124 circumscribing the access opening 68. The length of the first and second conduit 116, 118 is illustrated as varying for illustrative purposes only and is not meant to be limiting. In certain aspects of the disclosure herein a longer second fluid conduit 118 is beneficial for moving a treating chemistry through the inner chamber 64.

Non-limiting examples of treating chemistries that may be dispensed by the dispenser 60 during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. The treating chemistry may be in any suitable form, non-limiting examples of which include a powder, a liquid, a gel, granules, and combinations thereof.

Figure 3:
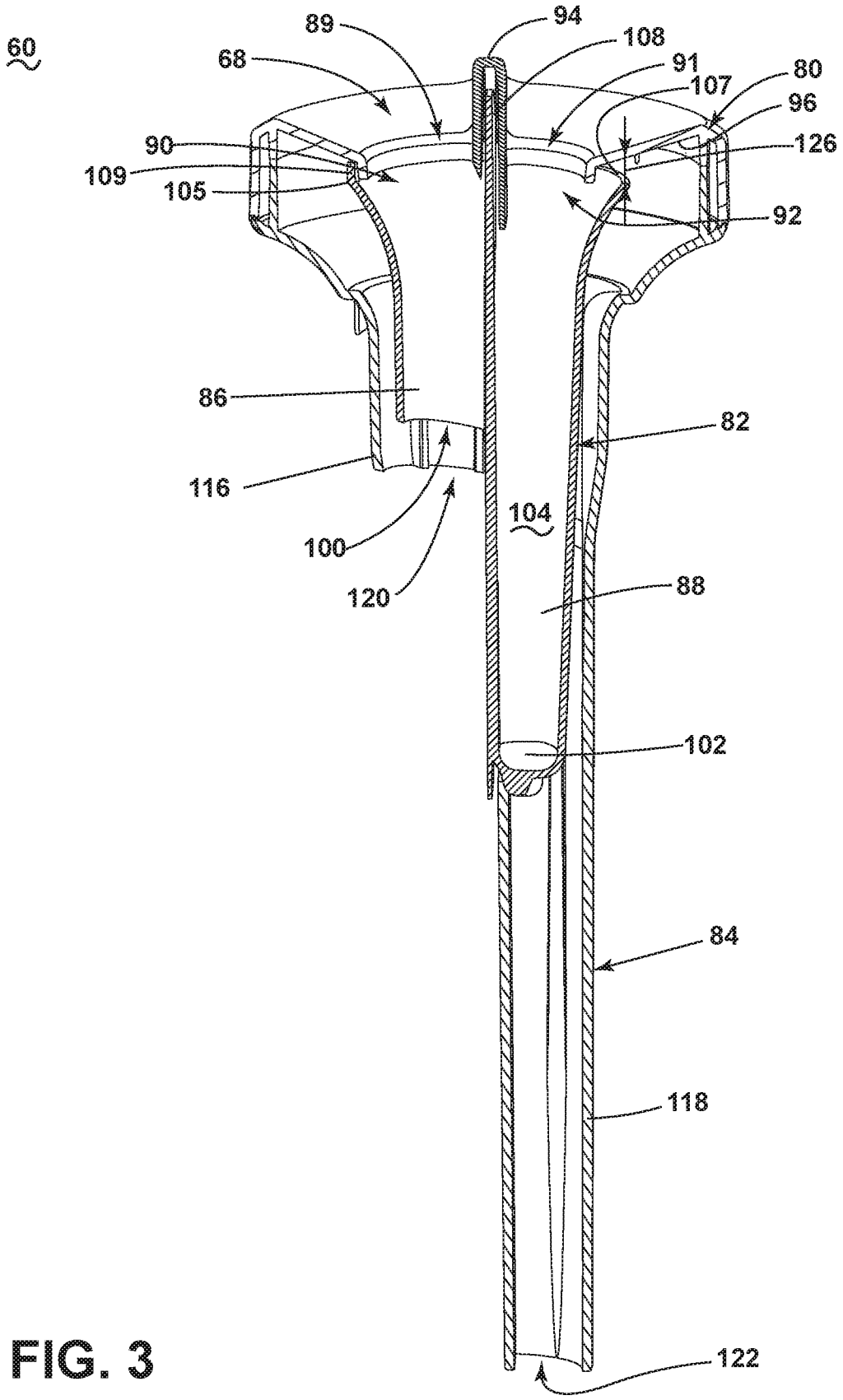
FIG. 3 is a perspective side view of the dispenser from FIG. 2 with the divider in place and illustrated in dashed line.

FIG. 3 illustrates an assembled dispenser 60 according to aspects of the disclosure described herein. The divider 82 is located between the funnel 84 and the cap 80. It can more clearly be seen that the tab 108 is received within the first dividing wall 94 when assembled ensuring that the at least two dispensing compartments 86, 88 are fluidly separate from each other. Furthermore, when assembled, the lip 109 extends to the cap 80 sealing off the flow-through dispensing compartment 86 from the first fluid conduit 116 at the first inlet 90. The centrifugal dispensing compartment 88 is fluidly coupled to the second fluid conduit 118 via a gap 126 formed between the semi-circular edge 107 and the cap 80, more specifically the splash guard 96.

Figure 4:
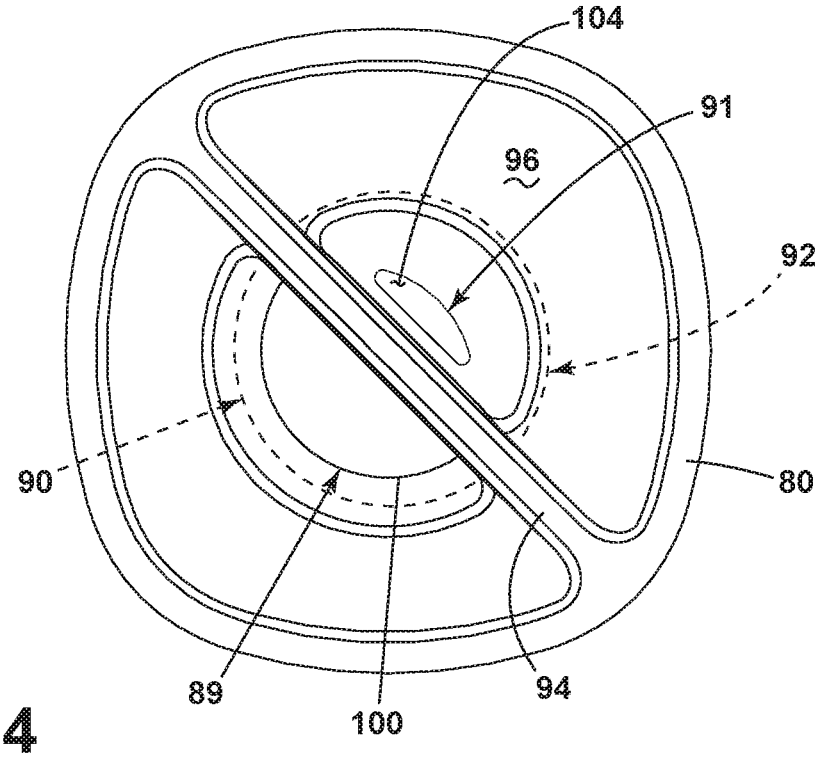
FIG. 4 is a top view of the dispenser from FIG. 2.

Referring now to FIG. 4, a top view of the dispenser 60 more clearly indicates the size differences between the first and second apertures 89, 91. When assembled, the first aperture 89, first inlet 90, opening 100, and outlet 120 (FIG.

5) all align with each other to form a through-hole 130 extending from the access opening 68 (FIG. 1) through to the inner chamber 64 (FIG. 1). The second aperture 91 provides access to the reservoir 104 of the divider 82 (FIG. 2).

Figure 5:
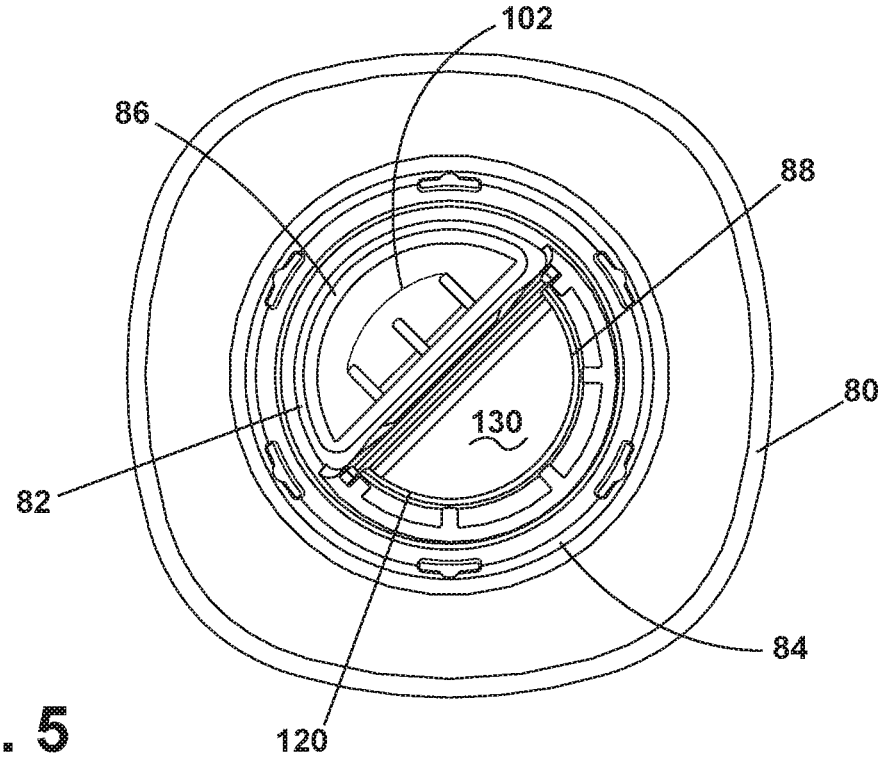
FIG. 5 is a bottom view of the dispenser from FIG. 2.

In a bottom view of the dispenser illustrated in FIG. 5 it can more clearly be seen that the reservoir 104 is at least partially defined by the closed end 102 of the centrifugal dispensing compartment 86. Again, the through-hole 130 is illustrated in the bottom view of the dispenser 60 indicating that any treating chemistry received in the flow-through dispensing conduit 88 will flow directly through the cap 80, divider 82, and funnel 84 respectively to the inner chamber 64.

Figure 6:
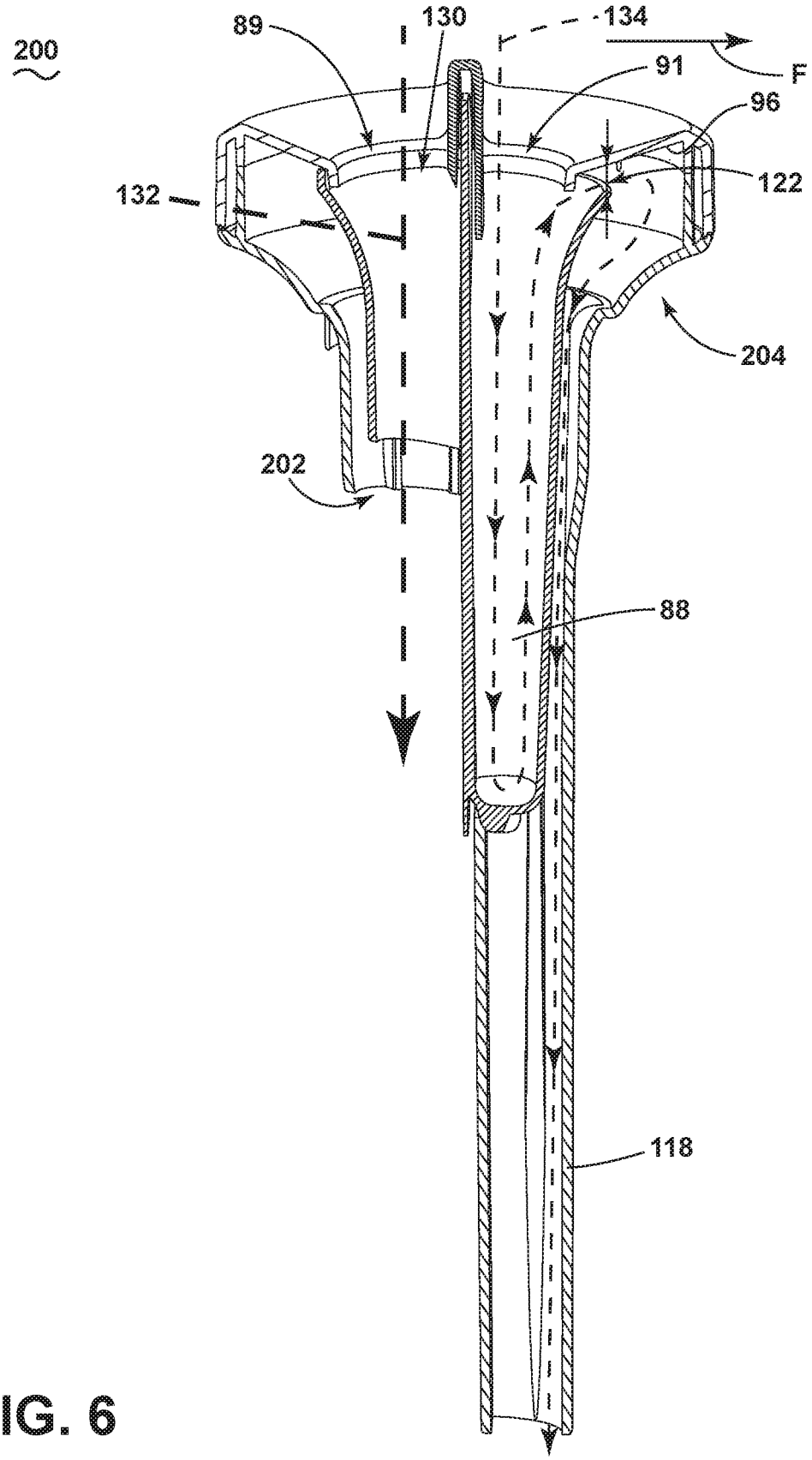
FIG. 6 is the same view as FIG. 3 illustrating a method for dispensing laundry treating appliance according to an aspect of the disclosure herein.

FIG. 6 depicts the dispensing of a first and second treating chemistry 132, 134 during operation of the laundry treating appliance. Some numbers have been eliminated for clarity. The first treating chemistry 132 is received through the first aperture 89 and passes into the dispenser 60 and through the through-hole 130 out of the first fluid conduit 116. A second treating chemistry 134 is received through the second aperture 91 and held in the reservoir 104. During a particular washing cycle of the washing machine 10, by way of non-limiting example a spinning cycle, the dispenser 60 is rotated and produces a centrifugal force (F) on the second treating chemistry 134 causing the second treating chemistry 134 to move up out of the reservoir 104, hit the splash guard 96, move through the gap 126, pass along the splash guard 96, and to be guided down into the second fluid conduit 118. The splash guard 96 doubles as a guide for moving the second treating chemistry 134 towards the second fluid conduit 118 while also preventing the second treating chemistry 134 from moving out of the upper end 72 of the column 70 (FIG. 1).

A method 200 of dispensing the at least two treating chemistries as described herein can include at 202 non-centrifugally dispensing the first treating chemistry 132 into the treating chamber 18 from the first dispenser, by way of non-limiting example the flow-through dispensing compartment 86, located within the clothes mover 20. It is further contemplated that non-centrifugally dispensing the first treating chemistry 132 can include flowing the first treating chemistry 132 through the inner chamber 64 of the clothes mover 20.

At 204 centrifugally dispensing the second treating chemistry 134 into the treating chamber 18 from the second dispenser, by way of non-limiting example the centrifugal dispensing compartment 88, located within the clothes mover 20. It is contemplated that centrifugally dispensing the second treating chemistry 134 can further include holding the second treating chemistry in the reservoir 104 of the second dispenser 88 until centrifugally dispensed. Furthermore, the centrifugally dispensing can include expelling the second treating chemistry 134 from the reservoir 104 by centrifugal force (F).

In aspects of the disclosure discussed herein, the second treating chemistry 134 can be dispensed after the first treating chemistry 132, by way of non-limiting example when the second treating chemistry is a fabric softener. It is further contemplated that the second treating chemistry 134 is dispensed at a different phase of the cycle of operation for the washing machine 10 than the first treating chemistry 132, by way of non-limiting example during a rinse phase in which the basket is spun at a speed sufficient to centrifugally move out the second treating chemistry 134. The method can also include immediately dispensing the first treating chemistry 134 in the case where the first treating chemistry 134 is a laundry detergent.

Figure 7:
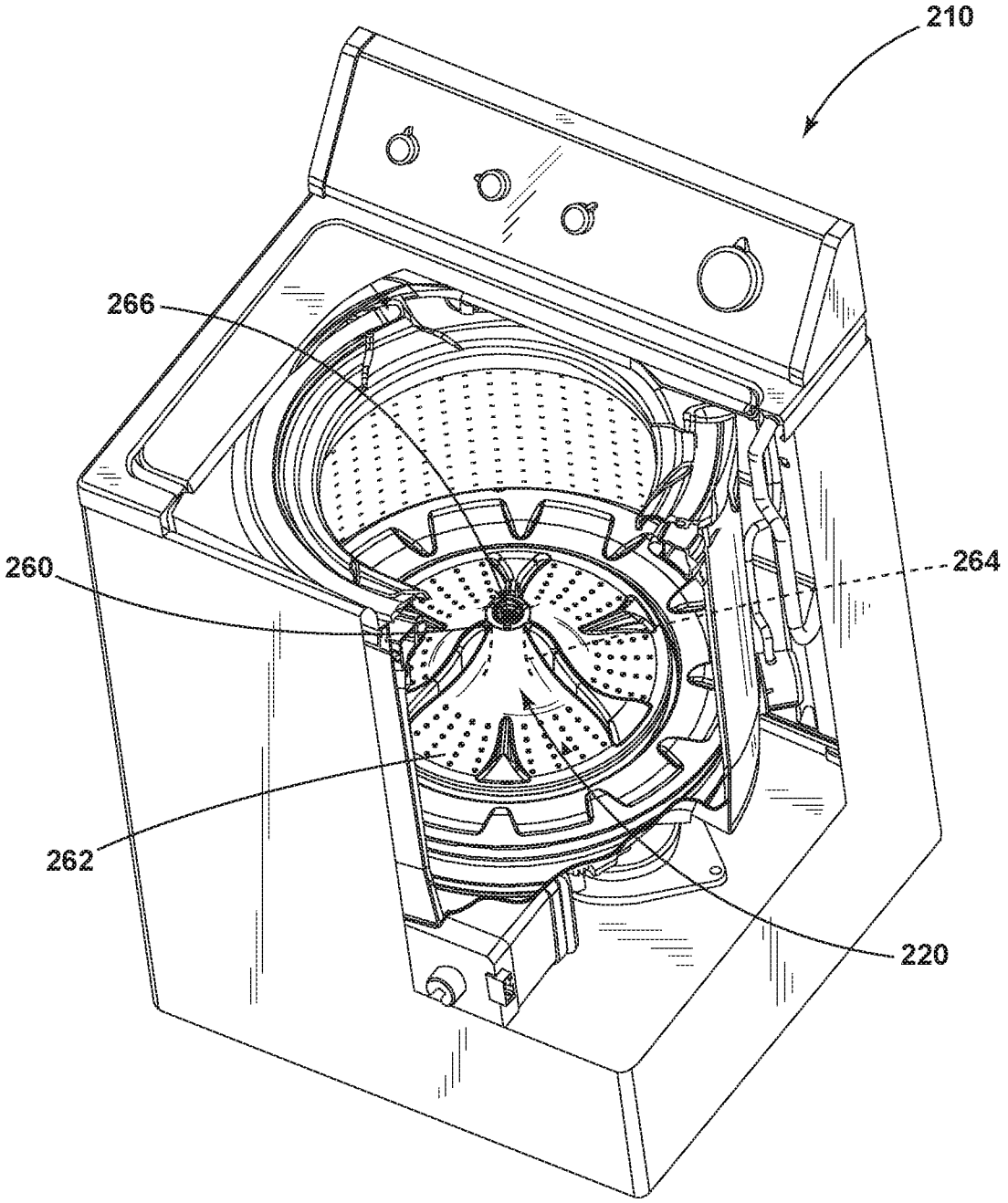
FIG. 7 is a perspective view of a laundry treating appliance in the form of a washing machine with an impeller according to another aspect of the disclosure herein.

FIG. 7 illustrates a vertical access washing machine 210 with a clothes mover 220 illustrated as an impeller. In one aspect of the disclosure herein, a base 262 can have a raised center 266 and an access opening 268 located at the raised center 166 where an inner chamber 264 is located below the raised center 266. A dispenser 260 can be received in the access opening 268 of the clothes mover 220.

Figure 8:
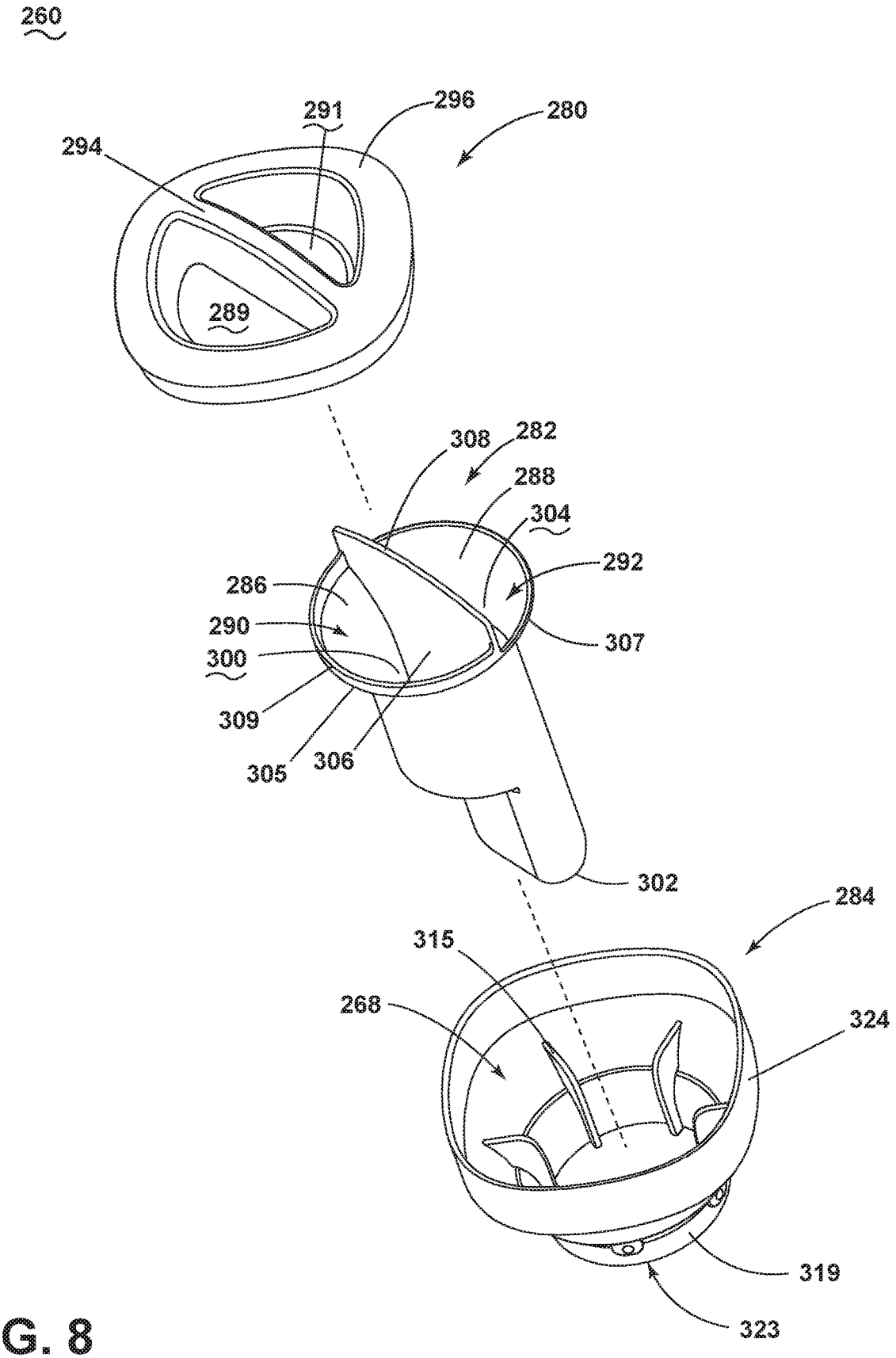
FIG. 8 is an exploded view of a dispenser for a laundry treating appliance of according to another aspect of the disclosure herein.

FIG. 8 is an exploded view of the dispenser 260 according to another aspect of the disclosure discussed herein. The dispenser 260 is substantially similar to the dispenser 60. Therefore, like parts will be identified with like numerals increased by 200, with it being understood that the description of the like parts of the dispenser 60 applies to the dispenser 260 unless otherwise noted.

In one non-limiting example, for the dispenser 260 to fit in an impeller as illustrated in FIG. 7, it is contemplated that a funnel 284 extends from an access opening 268 along a short conduit 319, when compared to the first and second fluid conduits 116, 118, to a single outlet 323. It is further contemplated that ribs 215 circumscribe an interior of the funnel 284 to hold a divider 282 in place. It should be understood that the dispenser 260 is not limited to placement in an impeller and can be used in any clothes mover as previously described herein.

Benefits associated with the dispenser disclosed herein include eliminating a valve used to dispense laundry treating chemistries in other known applications. The dispenser as disclosed herein requires no valves or moving parts. Additionally in the event a flush is required of the dispenser, a single water dispenser can be utilized to flush both dispenser compartments. The removability of the divider also enables easy cleaning between uses.

To the extent not already described, the different features and structures of the various aspects of the present disclosure may be used in combination with each other as desired. That one feature may not be illustrated in all of the aspects of the present disclosure is not meant to be construed that it cannot be, but is done for brevity of description. Thus, the various features of the different aspects of the present disclosure may be mixed and matched as desired to form new embodiments, whether or not the new embodiments are expressly described. For example, components 80, 82, and 84 can be combined in various combinations to form additional examples of dispensers without deviating from the scope of the present disclosure.

While the present disclosure has been specifically described in connection with certain specific embodiments thereof, it is to be understood that this is by way of illustration and not of limitation. Reasonable variation and modification are possible within the scope of the forgoing disclosure and drawings without departing from the spirit of the present disclosure which is defined in the appended claims.

What is claimed is:

1. A laundry treating appliance comprising:

a basket at least partially defining a treating chamber with an open top;

a clothes mover rotatable about a vertical axis within the treating chamber, the clothes mover defining an inner chamber and having an access opening to the inner chamber; and a dispenser at least partially received through the access opening and within the inner chamber, the dispenser comprising:

a cap having a first dividing wall, a divider having a divider body and a second dividing wall extending beyond the divider body to define a tab, the second dividing wall separating and partially forming at least two dispensing compartments, which are fluidly separate from each other and fluidly coupled to the treating chamber, and a funnel in which the divider is received, the funnel having ribs that circumscribe an interior of the funnel;

wherein the cap and the divider are removable and when assembled the tab is received within the first dividing wall.

2. The laundry treating appliance of claim 1 wherein the at least two dispensing compartments are first and second dispensing compartments.

3. The laundry treating appliance of claim 1 wherein the funnel comprises at least two fluidly separate fluid conduits.

4. The laundry treating appliance of claim 1 wherein the at least two dispensing compartments comprise at least one flow through dispensing compartment and one centrifugal dispensing compartment.

5. The laundry treating appliance of claim 1 wherein the cap further comprises at least two apertures, with each aperture fluidly coupled to a different one of the at least two dispensing compartments.

6. The laundry treating appliance of claim 5 wherein at least a portion of the cap defines a splash guard.

7. The laundry treating appliance of claim 5 wherein the at least two apertures are different sizes.

8. The laundry treating appliance of claim 1 wherein the clothes mover comprises a base.

9. The laundry treating appliance of claim 8 wherein the base comprises a raised center and the access opening is located at the raised center, with the inner chamber located below the access opening.

10. The laundry treating appliance of claim 8 wherein the clothes mover further comprises a column extending upwardly from the base and the inner chamber is located within the column.

11. The laundry treating appliance of claim 10 wherein the column terminates in an upper end that defines the access opening.

12. The laundry treating appliance of claim 1 wherein the funnel further comprises a pair of grooves and a portion of the second dividing wall extending beyond the divider body defines a pair of ridges received within the pair of grooves when assembled.

13. The laundry treating appliance of claim 1 wherein the funnel further comprises a pair of grooves and another portion of the second dividing wall extending beyond the divider body defines a pair of ridges received within the pair of grooves when assembled.

14. A laundry treating appliance comprising:

a basket at least partially defining a treating chamber with an open top;

a clothes mover mounted for rotational movement about a vertical axis within the treating chamber, the clothes mover defining an inner chamber and having an access opening to the inner chamber; and a dispenser at least partially received through the access opening and within the inner chamber, the dispenser comprising:

a cap having a first dividing wall, a divider having a divider body and a second dividing wall extending beyond the divider body to define a tab, the second dividing wall separating and partially forming a flow-through dispenser and a centrifugal dispensing compartment, which are fluidly separate from each other and fluidly coupled to the treating chamber, and a funnel in which the divider is received, the funnel having ribs that circumscribe an interior of the funnel;

wherein the cap and the divider are removable and when assembled the tab is received within the first dividing wall.

15. The laundry treating appliance of claim 14 wherein the centrifugal dispensing compartment comprises a reservoir.

16. The laundry treating appliance of claim 15 wherein the funnel comprises at least two fluidly separate fluid conduits.

17. The laundry treating appliance of claim 14 wherein the cap further comprises at least two apertures, with each aperture fluidly coupled to the flow-through dispenser and the centrifugal dispensing compartment.

18. The laundry treating appliance of claim 17 wherein at least a portion of the cap defines a splash guard.

19. The laundry treating appliance of claim 17 wherein the first dividing wall formed in the cap separates the at least two apertures.

20. The laundry treating appliance of claim 14 wherein the clothes mover further comprises a column extending upwardly from a base and terminating in an upper end which defines the access opening and the inner chamber is located within the column.

21. The laundry treating appliance of claim 14 wherein the funnel further comprises a pair of grooves.

22. The laundry treating appliance of claim 21 wherein the second dividing wall extends beyond the divider body to define a pair of ridges received within the pair of grooves when assembled.

* * * * *